US009239207B2

(12) United States Patent
Kresser

(10) Patent No.: US 9,239,207 B2
(45) Date of Patent: Jan. 19, 2016

(54) EXTENDABLE SLIDE MEMBER FOR PISTOL SLIDE

(71) Applicant: Taurus International Manufacturing, Inc., Miami, FL (US)

(72) Inventor: Mark Kresser, Miramar, FL (US)

(73) Assignee: Taurus International Manufacturing, Inc., Miami, FL (US)

( * ) Notice: Subject to any disclaimer, the term of this patent is extended or adjusted under 35 U.S.C. 154(b) by 1 day.

(21) Appl. No.: 14/073,099

(22) Filed: Nov. 6, 2013

(65) Prior Publication Data

US 2015/0121734 A1 May 7, 2015

(51) Int. Cl.

| | |
|---|---|
| ***F41A 1/08*** | (2006.01) |
| ***F41C 3/00*** | (2006.01) |
| ***F41A 3/72*** | (2006.01) |

(52) U.S. Cl.
CPC .... *F41C 3/00* (2013.01); *F41A 3/72* (2013.01)

(58) Field of Classification Search
CPC ..... F41C 3/00; F41C 3/72
USPC ..... 89/1.4, 1.14, 196, 147; 42/71.02, 90, 42/106, 16
See application file for complete search history.

(56) References Cited

U.S. PATENT DOCUMENTS

| | | | | |
|---|---|---|---|---|
| 885,436 | A | 4/1908 | Clement | |
| 956,430 | A * | 4/1910 | Schmeisser | 89/196 |
| 992,854 | A * | 5/1911 | Cobb | 89/147 |
| 1,187,888 | A | 6/1916 | Diehm | |
| 1,226,478 | A | 5/1917 | Diehm | |
| 1,290,855 | A | 1/1919 | Wesson | |
| 1,680,186 | A | 4/1924 | Frommer | |
| 2,744,448 | A * | 5/1956 | Allen | 89/196 |
| 5,050,481 | A | 9/1991 | Knight, Jr. et al. | |
| 5,275,084 | A | 1/1994 | Ruger | |
| 6,561,073 | B1 * | 5/2003 | Høgmoe | 89/1.42 |
| 7,451,683 | B2 | 11/2008 | Kellermann et al. | |
| 7,900,546 | B2 * | 3/2011 | Bordson | 89/1.4 |
| 8,104,393 | B2 * | 1/2012 | Kincel | 89/1.14 |
| 8,117,954 | B1 * | 2/2012 | Davis | 89/1.4 |
| 8,191,301 | B2 * | 6/2012 | Hatfield | 42/90 |
| 8,312,803 | B2 * | 11/2012 | Oz | 89/1.4 |
| 8,336,436 | B2 * | 12/2012 | Kincel | 89/1.14 |
| 8,438,774 | B2 * | 5/2013 | Sharp et al. | 42/90 |
| 8,448,373 | B2 * | 5/2013 | Matthews et al. | 42/114 |
| 8,468,734 | B2 * | 6/2013 | Meller et al. | 42/90 |
| 8,549,785 | B2 * | 10/2013 | Sharp et al. | 42/90 |
| D694,354 | S * | 11/2013 | Underwood | D22/108 |
| 8,650,794 | B2 * | 2/2014 | Swan et al. | 42/90 |
| D705,383 | S * | 5/2014 | Montes | D22/108 |
| D705,384 | S * | 5/2014 | Underwood | D22/108 |
| 8,960,066 | B2 * | 2/2015 | Gomez | 89/1.4 |
| 2002/0170224 | A1 * | 11/2002 | Lawless | 42/71.02 |
| 2004/0200109 | A1 * | 10/2004 | Vasquez | 42/1.01 |
| 2011/0010978 | A1 * | 1/2011 | Hooks | 42/69.01 |
| 2011/0088539 | A1 * | 4/2011 | Oz | 89/1.4 |

(Continued)

*Primary Examiner* — Michelle R Clement
(74) *Attorney, Agent, or Firm* — Robert Curcio; DeLio, Peterson & Curcio, LLC

(57) ABSTRACT

An extendable slide member on a pistol slide action, providing leverage and a gripping base for a user to pull back or "rack" the slide along guides on a pistol frame, in a longitudinal motion relative to the pistol frame. The slide member facilitating racking the slide when in an extended position the slide member rotates either laterally outwards from a side surface of the slide or vertically upwards from a top surface of the slide, and presents a gripping segment for the user to pull the slide towards the breech end of the pistol.

21 Claims, 12 Drawing Sheets

(56) References Cited

U.S. PATENT DOCUMENTS

| | | | | |
|---|---|---|---|---|
| 2011/0154710 | A1* | 6/2011 | Hatfield | 42/90 |
| 2011/0226120 | A1* | 9/2011 | Fitzpatrick et al. | 89/1.4 |
| 2011/0283587 | A1* | 11/2011 | Sharp et al. | 42/90 |
| 2012/0198744 | A1* | 8/2012 | Meller et al. | 42/90 |
| 2012/0291612 | A1* | 11/2012 | Kincel | 89/1.4 |
| 2013/0061737 | A1 | 3/2013 | Brown | |
| 2013/0081318 | A1* | 4/2013 | Morando | 42/108 |
| 2013/0228065 | A1* | 9/2013 | Fitzpatrick et al. | 89/1.4 |
| 2013/0255478 | A1* | 10/2013 | McAninch | 89/1.4 |
| 2014/0020549 | A1* | 1/2014 | Bayly | 89/1.4 |
| 2014/0150325 | A1* | 6/2014 | Keng et al. | 42/118 |
| 2014/0298703 | A1* | 10/2014 | Gale et al. | 42/71.02 |

* cited by examiner

EXTENDABLE SLIDE MEMBER FOR PISTOL SLIDE

BACKGROUND OF THE INVENTION

1. Field of the Invention

The present invention relates to semi-automatic firearms. Particularly it concerns hand-held pistols or repeating handguns having a slide action mechanism. More particularly, the present invention relates to facilitating the pulling or "racking" of a pistol slide using an extendable slide member on the slide action.

2. Description of Related Art

Conventionally designed pistols generally have a breech in the form of an exposed slide, which is movably arranged on a frame in the longitudinal direction, that is, in the direction along the length of the barrel. The frame, consisting of metal or plastic, serves to hold the mechanical parts of the firearm, such as the trigger housing and bolt carrier group. The frame includes a grip portion that receives the magazine. The frame provides support for the control and guide elements for the slide.

The slide is the part of the weapon on a majority of semi-automatic pistols that moves during the operating cycle and generally houses the firing pin or striker and the extractor, and serves as the bolt. A bolt is a mechanical part of a firearm that blocks the rear of the chamber while the propellant burns, but moves out of the way to allow another cartridge or shell to be inserted in the chamber.

In an automatic or semi-automatic firearm, the bolt cycles back and forward between each shot, propelled by recoil or expanding gas (back) or the recoil spring (forward). When it moves back, an extractor pulls the spent casing from the chamber. When it moves forward, it strips a cartridge from the magazine and pushes it into the chamber. Once the cartridge case is clear of the chamber, the ejector kicks the case out of the weapon. The extractor and firing pin are often integral parts of the bolt. The slide of a semi-automatic pistol is a form of bolt. It is spring-loaded so that once it has moved to its rearmost position in the firing cycle, spring tension brings it back to the starting position chambering a fresh cartridge during the motion, provided that the magazine is not empty.

The majority of semi-automatic pistols in use are essentially of the single action type in which a firing pin, typically impacted by a hammer, is cocked into firing position by recoil of the slide when the weapon is discharged by the pull of the trigger. Some of these weapons may be double action on loading of the first round, but single action thereafter for all rounds in the magazine, and thus, are not double action only weapons.

Operation of a semi-automatic pistol requires one to first load bullets into a magazine. Next, a magazine is inserted into the pistol, usually within the pistol grip portion. A magazine is an ammunition storage and feeding device within or attached to a repeating firearm, such as a semi-automatic pistol. Magazines may be integral to the firearm (fixed) or removable (detachable). The magazine functions by moving the cartridges stored in the magazine into a position where they may be loaded into the chamber by the action of the firearm. The slide is pulled back and released, which serves to load the cartridge or round into the chamber and cocks the hammer. The function of the hammer is to strike the firing pin, which in turn detonates the impact-sensitive cartridge primer. With each trigger pull, a round is fired and a new one is automatically loaded, ready for another trigger pull.

In order to fire a double action pistol, the magazine is first loaded, the slide is then pulled back or "racked", and a cartridge or round is placed in the chamber. Firing is then initiated by pulling the trigger. The trigger pull is cocking the hammer first. Then after it fires, the pistol will load a fresh round in and cock the hammer, so the second trigger pull is much shorter and lighter.

In a striker fire pistol, a striker is similar to a firing-pin with the exception of a spring being located in back of the striker and forcing it to the front. When the pistol is cocked a sear holds the striker in a rearward position. When the pistol is fired the sear releases the striker, which flies forward under the impetus of its spring and strikes the primer.

In a double-action striker-fired pistol, when the slide is racked, the striker is latched back far enough to be clear of the breech face when feeding a round into the chamber, but not far enough to fire the pistol if released. When the trigger is pulled, the striker is pulled back farther, and then released.

It is sometimes difficult for some people to pull or "rack" the slide on pistols, due to weak hand strength, grip, age, and/or related medical conditions, like arthritis or joint tenderness. New shooters are sometimes too gentle with a pistol and are afraid of slide "bite" to definitively and aggressively rack the slide as they should. It is understood, however, that shooters cannot operate a semi-automatic pistol efficiently for loading, unloading, and clearing malfunctions without racking the slide properly and quickly. Thus, there remains a need in the art for facilitating proper racking of the slide on a pistol.

Racking the slide simply means manipulating and moving the slide back and forth on its guide rails. There are many ways and considerations for racking the slide. Even some experienced competitors have demonstrated that they cannot optimally rack the slide to perform reloads. Others have concluded that they have no choice but to use a revolver, rather than a semi-automatic pistol, especially for concealed carry purposes, because they cannot rack the slide. Consequently, racking the slide is a prevalent issue in pistol ownership and shooting, and the user must be confident to perform this function effectively.

Two common methods for racking the slide are the "sling shot" method and the "over-the-top" method. For the sling shot method, the thumb and index finger of the support hand are in a "V" position to grasp or pinch the back of the slide on the slide grip portion, which is generally a serrated section of the breech end of the slide, and quickly pull the slide to the rear, not unlike shooting a slingshot. A length of the slide is pinched and grasped for better control. Concurrently with the grasping of the slide with the support hand, the strong hand is quickly pushed forward away from the shooter's body. Throughout this action, the grasped slide must be tightly held.

In the over-the-top method, the shooter's support hand is used to grasp the rear slide serrations over the top of the slide. For a right-handed shooter, the heel of the support hand rests on the left-side serrations, while the outside, right-side serrations, are grasped with the four fingers of the support hand. This method yields a more powerful grip on the slide because more fingers and the heel of the support hand are used for added strength. Again, throughout this action, the grasped slide must be tightly held.

Moreover, the slide must be moved back to a lock position in order to insert a new loaded magazine, for cleaning purposes, or to insert a new magazine when a magazine follower automatically locks the slide back when the spent magazine becomes empty. To lock the slide to the rear, the slide stop lever is pushed up as the slide is racked backwards by the support hand, and before it travels forward. Many shooters will shift their strong grip hand around to the left (for a right-handed shooter) so they can lift up the slide stop lever with their strong-hand thumb.

It is apparent from these methods that proper technique and a strong grip are required to rack the slide. Older shooters, shooters with certain medical conditions, weaker shooters, younger shooters, and others with difficulty racking the slide would benefit from an easier way to reduce the grasping force while securing the grip.

SUMMARY OF THE INVENTION

Bearing in mind the problems and deficiencies of the prior art, it is therefore an object of the present invention to provide a pistol slide that allows a user to more easily and efficiently pull or rack the slide back.

It is another object of the present invention to provide a modified pistol slide to facilitate racking.

It is a further object of the present invention to incorporate an extendable member on a pistol slide that enables a user to establish a firm grip for pulling the slide in relation to the pistol frame.

The above and other objects, which will be apparent to those skilled in the art, are achieved in the present invention which is directed to a pistol slide having a top surface, side surfaces adjacent the top surface, a breech end, and a muzzle end opposite the breech end, the pistol slide including: at least one extendable and retractable slide member located proximate the breech end of the slide, the slide member extending approximately laterally outwards from the side surface when the slide member is in an extended position.

The slide member is approximately flush-mounted with a side surface of the slide when the at least one slide member is in a retracted position.

The pistol slide includes at least one slot for receiving each of the at least one slide members, the slot defined by a bottom surface, a breech end side wall, a muzzle end side wall, and a top segment, and formed such that the slide member is received within the slot.

The top segment and the breech end side wall of the slot form a first groove, and the top segment and the muzzle end side wall of the slot form a second groove.

The slide member includes a connection segment for rotatably attaching to the slide. The connection segment may comprise an approximate cylindrical shape for rotatably attaching to the slide at the first groove of the slot.

The first groove may extend circumferentially more than 180° about the approximate cylindrical shape of the connection segment, securing the connection segment within the first groove while simultaneously allowing the connection segment to rotate relative to the slide.

The slide member may include a lever arm adjacent to, and extending from, the connection segment such that the lever arm extends laterally outwards from the slide side surface when the slide member is in the extended position. The slide member may also include a handle portion adjacent the lever arm, the handle portion having a lip portion extending approximately vertically upwards towards the slide top surface, the lip portion formed to fit within the second groove of the slot.

The pistol slide may further include an aperture within the slide slot proximate the first groove; a bias member insertably supportable within the aperture; and a ball bearing biased by the bias member extending partially into the first groove, forming a biased detent for the connection segment.

The slide member may be removably secured to the slide by magnetic contact.

In a second aspect, the present invention is directed to a pistol comprising: a frame for holding mechanical parts of the pistol, including a trigger housing and a bolt carrier group, the frame further includes a grip portion that receives a magazine; a slide, longitudinally slidable with respect to the frame, the slide housing a firing pin or striker of the pistol and an extractor, the slide serves as a bolt for the pistol, the slide having side surfaces adjacent the top surface, a breech end, and a muzzle end opposite the breech end; and at least one extendable and retractable slide member rotatably attached to the slide, the slide member located proximate the breech end of the slide, the slide member approximately flush-mounted with a side surface of the slide when the slide member is in a retracted position, and the slide member extending approximately laterally outwards from the side surface when the slide member is in an extended position.

The slide member for the pistol includes: a connection segment for rotatably attaching to the slide; a lever arm for gripping by a shooter when the slide member is in the extended position; and a handle portion for grasping the slide member to extend the slide member laterally outwards from the slide.

The slide includes a slot within the slide for receiving the slide member, the slot defined by a bottom surface, a breech end side wall, a muzzle end side wall, and a top segment, and formed such that the slide member is received within the slot and approximately flush-mounted with the side surface when the slide member is in the retracted position.

In a third aspect, the present invention is directed to a pistol slide having a top surface, side surfaces adjacent the top surface, a breech end, and a muzzle end opposite the breech end, the pistol slide including: at least one extendable and retractable slide member located proximate the breech end of the slide, the slide member rotatable approximately vertically upwards from the top surface to place the slide member in an extended position for grasping.

The slide member is approximately flush-mounted with the top surface of the slide when the slide member is in a retracted position.

The pistol slide includes a slot for receiving the slide member, the slot formed such that the slide member is received within the slot and flush-mounted with the top surface.

The slide member includes a front member and two leg members forming a U-shape, and the slot includes corresponding grooves for receiving the front member and the leg members.

The slide member is rotatable vertically upwards pivoting about the breech end of the leg members. The slide member extends rearwards relative to the slide such that a user may grasp the slide member and pull the slide rearwards.

In a fourth aspect, the present invention is directed to a method of racking a pistol having a pistol slide and a slide member rotatably attached to the pistol slide, comprising: grasping a portion of the slide member in a retracted position and rotating the slide member at least partially laterally outwards from a side surface of the slide such that the slide member is in an extended position; grasping the slide member in the extended position and pulling the slide member towards a breech end of the pistol thereby racking the pistol; and returning the slide member to the retracted position to ready the pistol for firing.

In a fifth aspect, the present invention is directed to a method of racking a pistol having a pistol slide and a slide member rotatably attached to the pistol slide comprising: grasping a portion of the slide member in a retracted position and rotating the slide member vertically upwards from a top surface of the slide such that the slide member is in an extended position; grasping the slide member and pulling the lever arm towards a breech end of the pistol thereby racking the pistol; and returning the slide member to the retracted position to ready the pistol for firing.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 5A depicts a top perspective view, while FIG. 5B depicts an exploded partial view of the attachment scheme;

DESCRIPTION OF THE PREFERRED EMBODIMENT(S)

In describing the preferred embodiment of the present invention, reference will be made herein to FIGS. 1-12 of the drawings in which like numerals refer to like features of the invention.

In one embodiment, the present invention introduces an extendable slide member on at least one side of a pistol slide action, and preferably on both sides of a pistol slide action that provides leverage and a gripping base for a user to pull back or "rack" the slide along guides on a pistol frame, in a longitudinal motion relative to the pistol frame.

Figure 1:
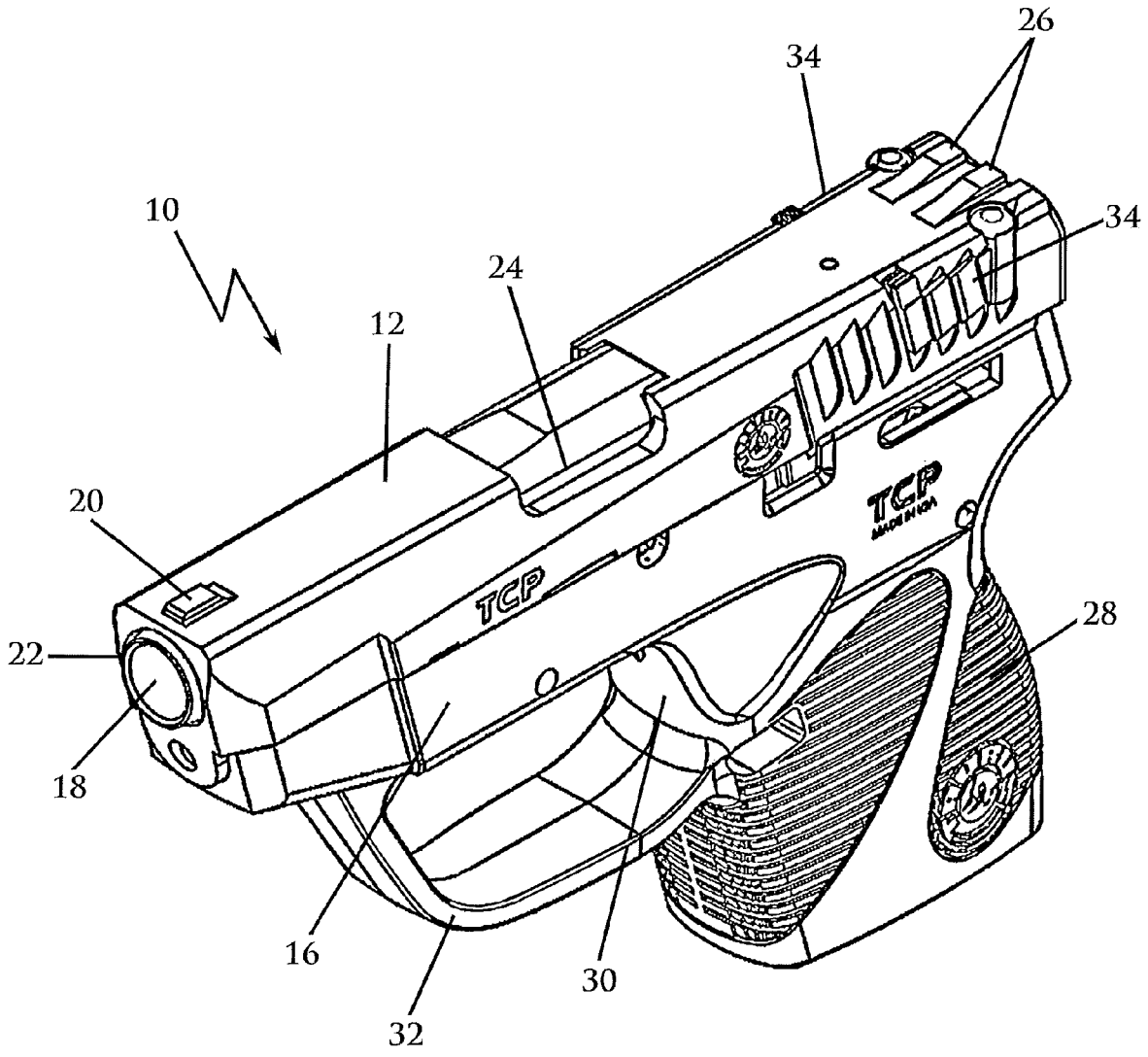
FIG. 1 is a top perspective view of a pistol having a slide embodying a slide member of the present invention in its retracted position.

FIG. 1 is a top perspective view of a pistol 10 having a slide 12 embodying slide members 34 of the present invention. Slide 12 is slidably engaged on guide rails (not shown) and movable longitudinally in relation to frame 16 (along the axis of the barrel). In the FIG. 1 configuration, slide 12 is in a forward position, before a user retracts or racks the slide to load a cartridge into the chamber. Slide 12 is biased in the forward position, and force must be applied to move the slide towards the breech end of the pistol.

Pistol 10 represents a common pistol construction with general components including a barrel 18, a forward sight 20, a muzzle 22, a slide 12 with an ejection aperture 24, a rear sight 26, a grip 28, trigger 30, and trigger guard 32, to name a few. In this first embodiment, the present invention introduces at least one slide member 34, and in this illustrative example, two slide members 34, that essentially extend a gripping portion of slide 12 in the lateral direction to facilitate gripping or holding the slide when a user attempts to rack the slide. In a preferred embodiment, two slide members 34 are used on each side of slide 12 for delivering a balanced retraction force during racking. Slide members 34 may be integral with slide 12. Slide members 34 may be in a fixed position, extending laterally outwards from slide 12; however, more preferably, slide members 34 are movably attached to slide 12 so that each is an extendable and retractable member. In this manner, slide member 34 provides an extended grip portion or finger-hold for assisting the user in racking the slide without slipping or instigating "slide bite", and can be fully retracted so as not to affect the slim-lined nature of the pistol.

Slide 12 with slide members 34 may still include serrations 42 for enhancing the user's hand grip on the slide. Serrations 42 may further be formed on slide members 34 as well in the event the user elects to rack slide 12 by conventional gripping, without extending slide members 34 laterally outwards.

In FIG. 1, slide members 34 are extendable and retractable components, shown here in a flush mount configuration. That is, in their retracted position, slide member 34 is at least approximately flush with the corresponding longitudinal side of slide 12. A flush mount configuration allows the pistol to have a compact contour, which reduces the chances of having the slide member, and consequently the pistol, catch on clothing or other objects during use, during holstering, and generally when the pistol concealed carried.

Figure 2:
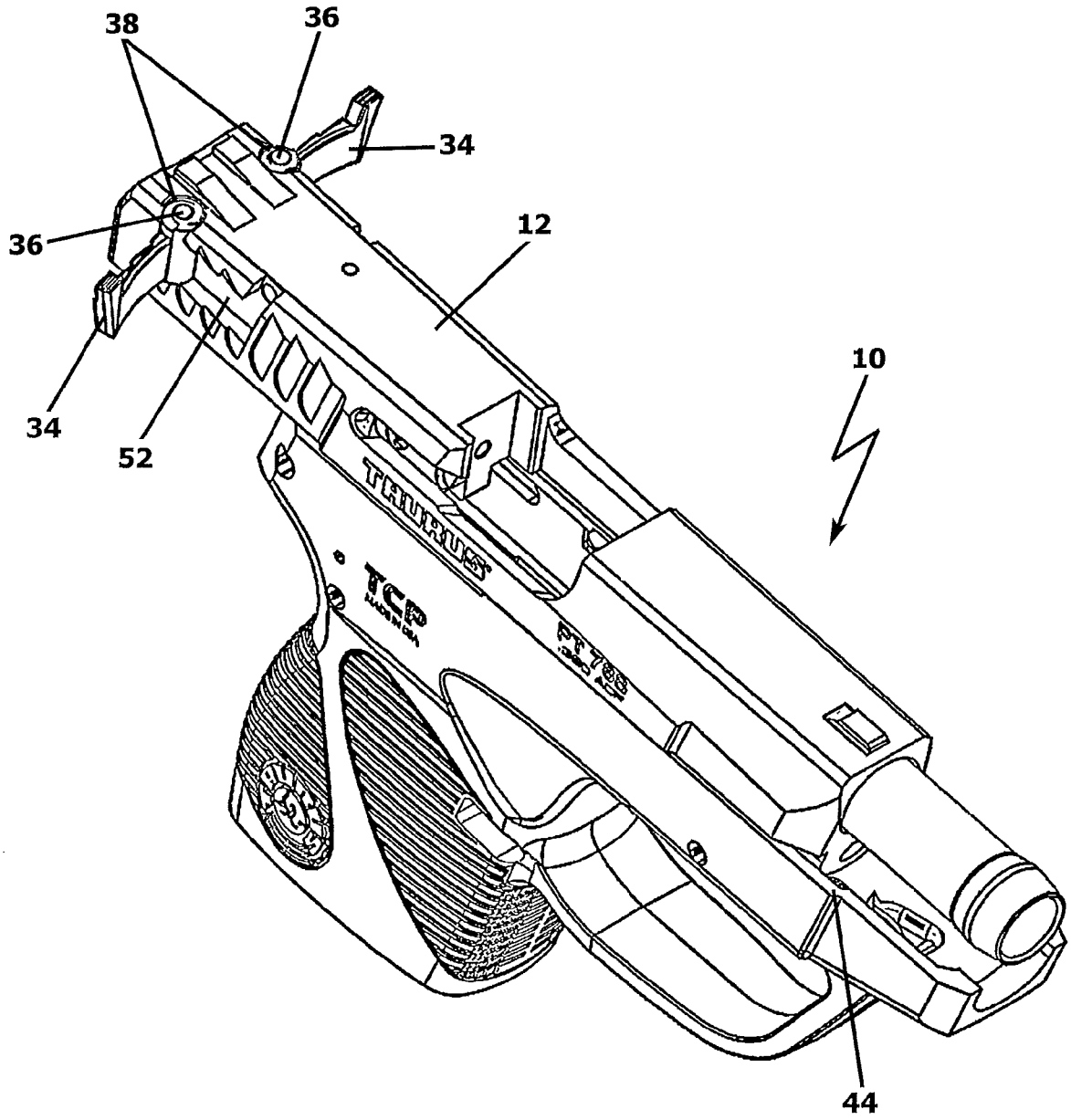
FIG. 2 depicts the pistol of FIG. 1 with the slide in the racked position, with slide members presented in an extended position.

FIG. 2 depicts a perspective view of pistol 10 of FIG. 1 with slide 12 in the racked position, where slide 12 has been pulled back on guide rails 44. Slide members 34 are in the extended position to facilitate racking the slide. In this embodiment, each slide member 34 is rotatably attached to slide 12. As shown in FIG. 2, slide members 34 include an axial, predominantly cylindrical connection segment 36 that may be secured to a complementary cylindrically shaped groove 38 at the breech end of slot 52, which receives slide member 34.

Figure 3:
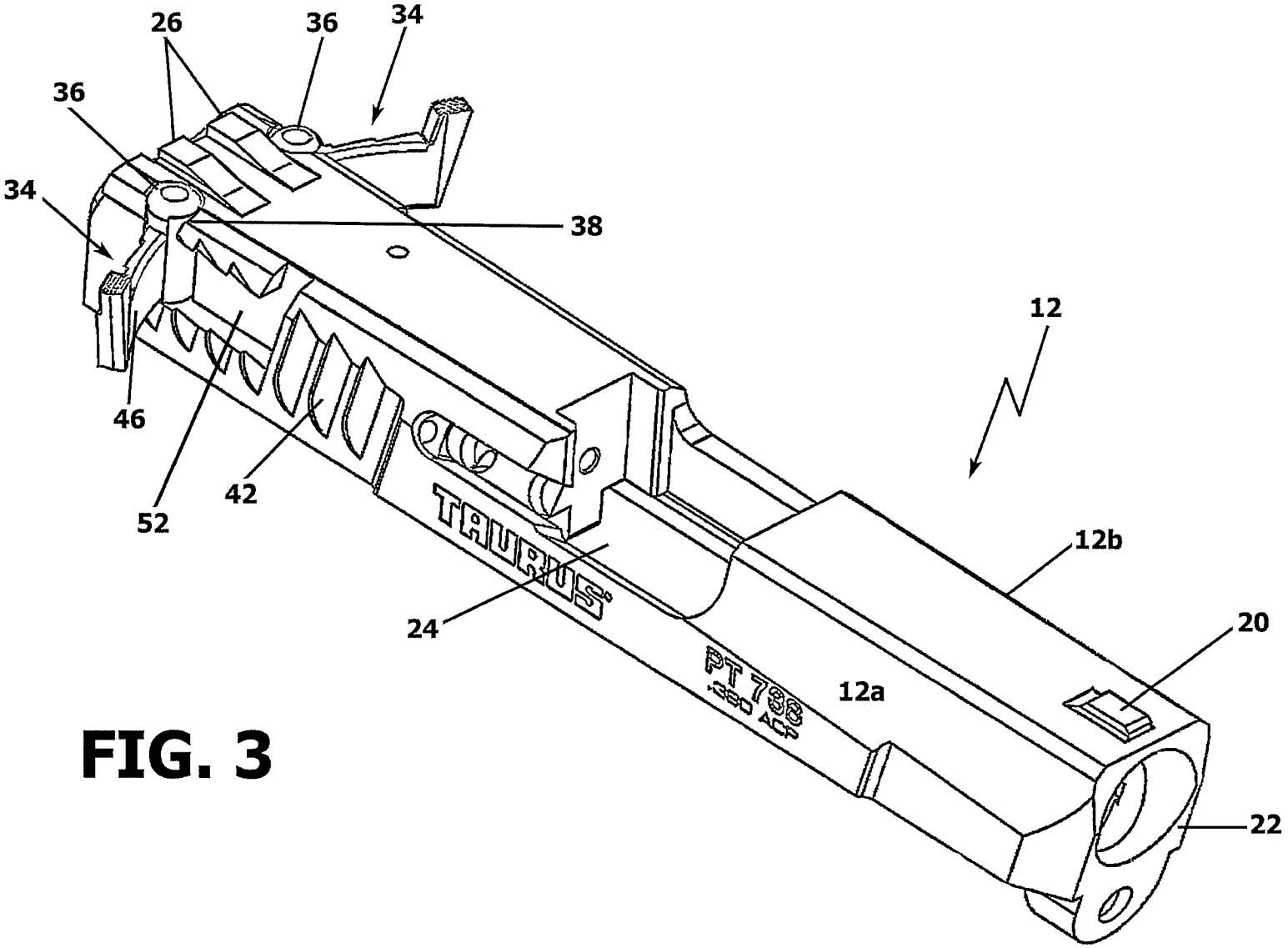
FIG. 3 depicts a perspective view of the slide of FIG. 1 with the slide members in the extended position.

FIG. 3 depicts a perspective view of slide 12 of the present invention with slide members 34 in the extended position. One end of each slide member 34 defines connection segment 36 predominantly cylindrical in shape having a longitudinal axis parallel to the respective adjacent face 12*a,b* of slide 12. Connection segment 36 is rotatably secured to slide 12. Slide 12 includes slots 52 to receive each slide member 34. Connection segment 36 of slide member 34 is held in place by a groove 38, which is located at the top portion of slide 12, and forms part of slot 52. Connection segment 36 may be snap-fitted within groove 38, or held in place by the vertical insertion of connection segment 36 within groove 38, such that the curvature of groove 38 extends more than 180° about the cylindrical connection segment 36 to secure the top of connection segment 36 while allowing for rotation.

Figure 4:
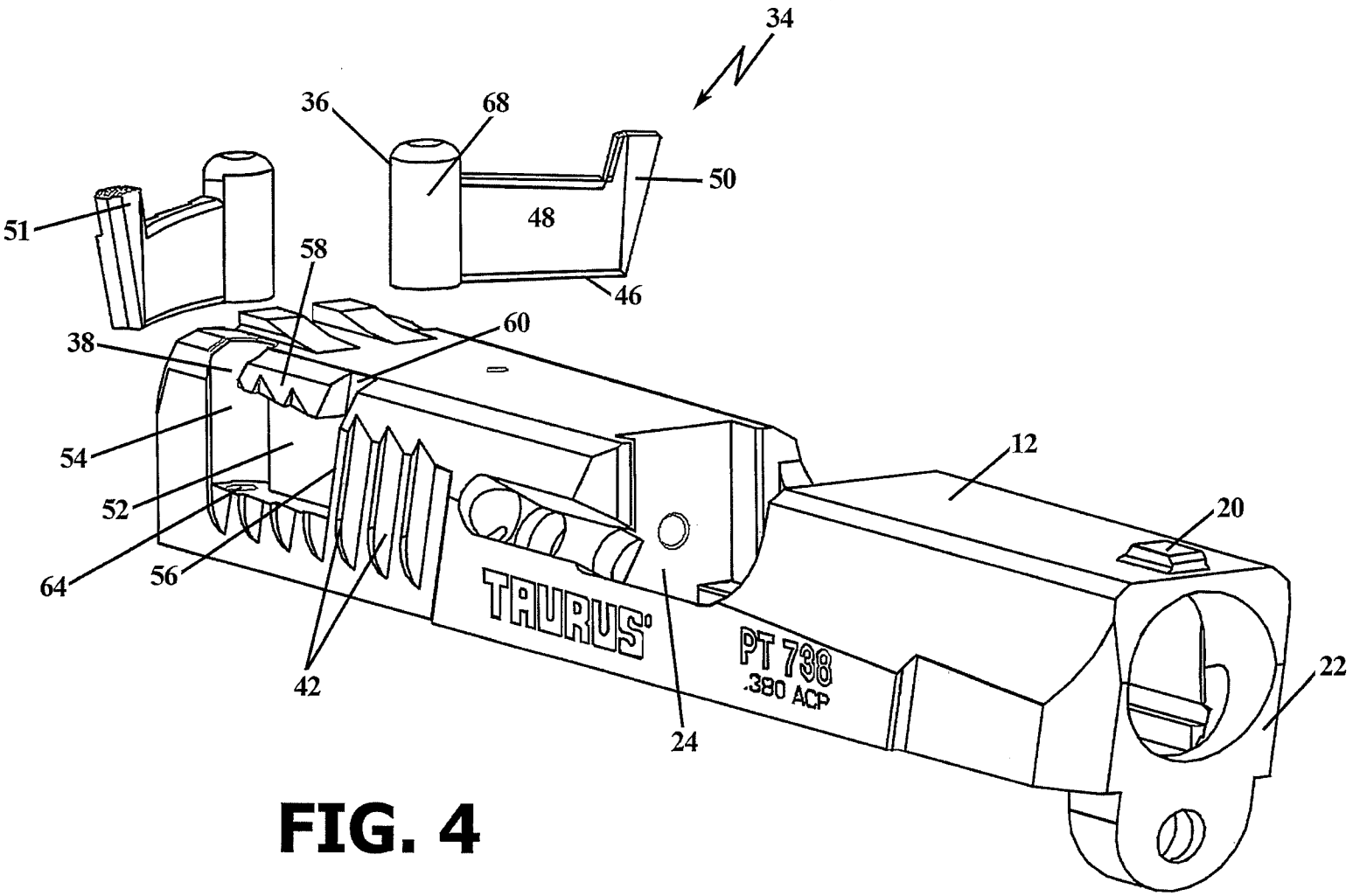
FIG. 4 depicts an exploded view of the slide of FIG. 3 with the slide members shown unattached.

FIG. 4 depicts an exploded view of slide 12 of the present invention with each slide member 34 shown unattached. In this exemplary embodiment, slide member 34 includes a lever arm 46 extending from connection segment 36. Lever arm 46, when extended, provides a gripping surface 48 facing the muzzle end of the pistol, for pulling the slide back. Lever arm 46 may be slightly curved concave inwards, that is towards slide 12 when slide member 34 is in its retraced, flush-mounted position. The curvature assists the gripping action to rack the slide, providing a more secure "hold" for the user's fingers.

When slide member 34 is in the retracted position, lever arm 46 is secured within slot 52 of slide 12. Slot 52 is defined on slide 12 by sidewall 54, located at the breech end of slot 52, and sidewall 56, located at the muzzle end of slot 52. A top segment 58 on slide 34 defines a top portion of slot 52. At one end, top segment 58 extends to, and partially forms, groove 38 with sidewall 54, to assist in securing connection segment 36. At the forward or breech end of slot 52, top portion 58 extends to groove 60 to form a gap with sidewall 56 for securing a handle portion 50 of slide member 34 opposite connection segment 36.

Handle portion 50 of slide member 34 is at an end of slide member 34, opposite connection segment 36, and is an upward extending portion adjacent to, and integral with, lever arm 46. Handle portion 50 is designed to extend at least to the top surface of slide 12 and top segment 58 in order to provide a vertical extension 51 for grasping slide member 34 to extend slide member 34 laterally outwards. Handle portion 50 may further form a snug or snap fit with groove 60, allowing slide member 34 to be held securing in place when in the retracted position.

The bottom surface of slot 52 preferably includes an indentation 64 positioned to receive the center of connection segment 36 when connection segment 36 is placed within groove 38 of slot 52. Indentation 64 is adapted to receive a detent or pin 66 located on the bottom of connection segment 36 of slide member 34 to secure the bottom of connection segment 36 in the bottom of slot 52. Conversely, a detent may be located on the bottom surface of slot 52 and received by an indentation in the bottom of connection segment 36. The combination of the detent/indentation forms a pivot point that secures the bottom of connection segment 36 while allowing for rotation. Curved groove 38 at the upper portion of slot 52 wraps partially around connection segment 36 at the top portion of connection segment 36 and serves to hold rotatable slide member 12.

Figure 5B:
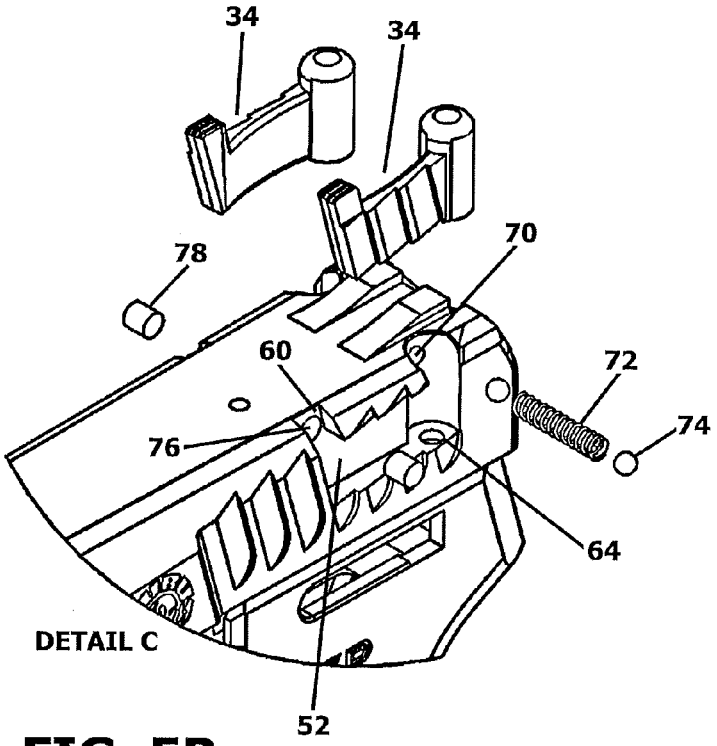
FIGS. 5A and 5B depict an attachment scheme for side mounted slide members.
Figure 5A:
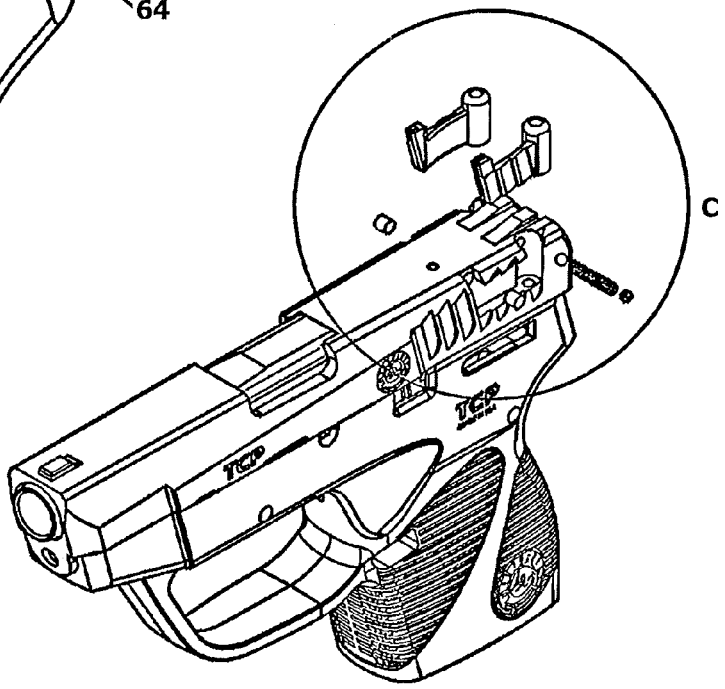

FIGS. 5A and 5B depict an attachment scheme for a side mounted slide member 34. In one embodiment, slot 52 includes a through-hole 70 that is situated behind connection segment 36 of slide member 34. Through-hole 70 is designed to receive a resilient bias member, such as spring 72, and ball bearing 74, that are compressible within through-hole 70 when connection segment 36 is in place. This attachment mechanism applies a bias force against connection segment 36 to hold slide member 34 in position. Grasping handle portion 50 and extending lever arm 46 laterally outwards will slightly compress bearing 74 against spring 72, allowing connection segment 36 to rotate more easily. Connection segment 36 may include an indentation to receive bearing 74 and secure connection segment 36 in place.

Alternatively, connection segment 36 may include at least one flattened side 68 to assist in forming a "locking" or "secured" indication when slide member 34 is fully retracted within slot 52 (Refer: FIG. 4). When connection segment 36 is rotated to retract slide member 34, flattened side 68 presents an edge to the backside of slot 52 that, upon further retracting rotation of slide member 34, would effectively "click" into place; thereby allowing the user of a positive indication of securing slide member 34.

Additionally, at the opposite end of slide member 34, handle portion 50 may be configured to firmly fit or snap in place within groove 60, providing another securing mechanism and physical indication of attachment. Both fits are sufficient to hold slide member 34 in its retracted position during normal handling of the firearm and during shooting, but resilient enough to allow for hand release and extension of slide member 34.

In another embodiment slide member 34 may be removably secured to the slide by a magnetic contact 78 located within an aperture 76 of slide 12, or complementary magnetic contacts located respectively on slide member 34 and the slide 12. FIGS. 5A and 5B depict an embodiment with slide member held from extension from the slide by a magnetic contact 78.

Figure 6:
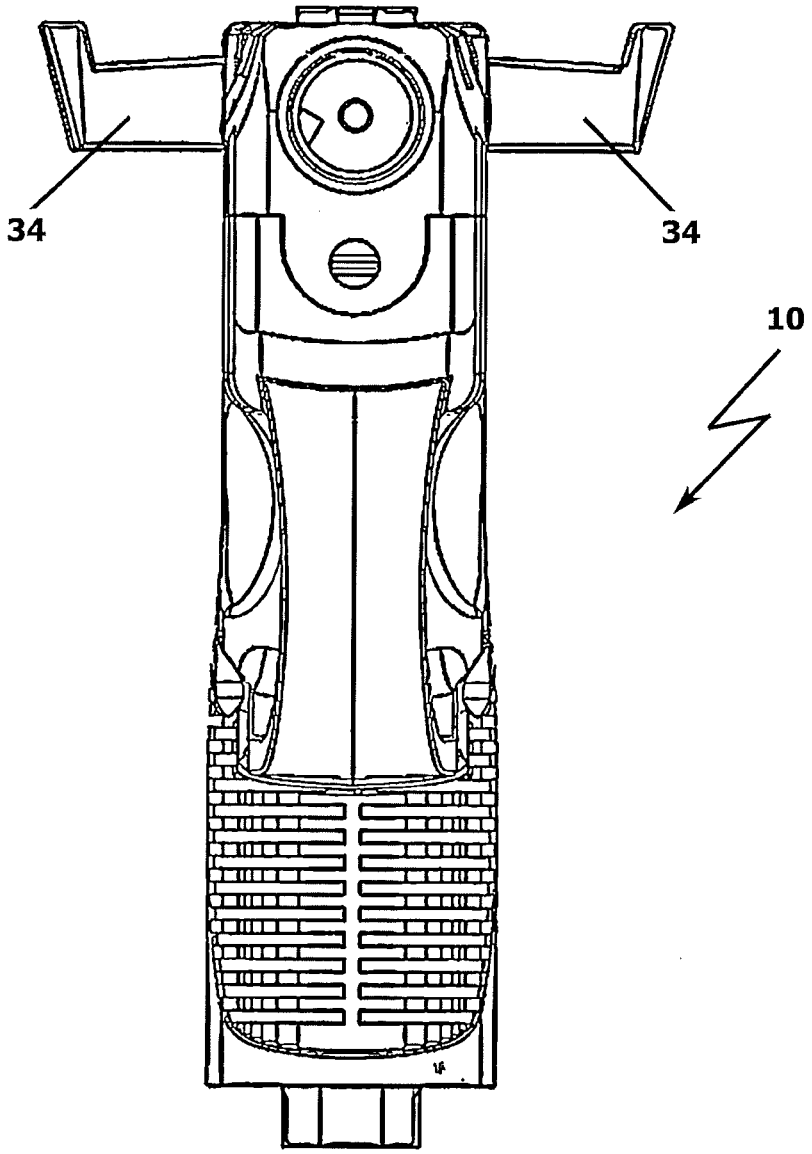
FIG. 6 depicts a front perspective view of the pistol of FIG. 1 with slide members laterally extended.

FIG. 6 depicts a front perspective view of pistol 10 of the present invention with slide members 34 laterally extended.

Figure 7:
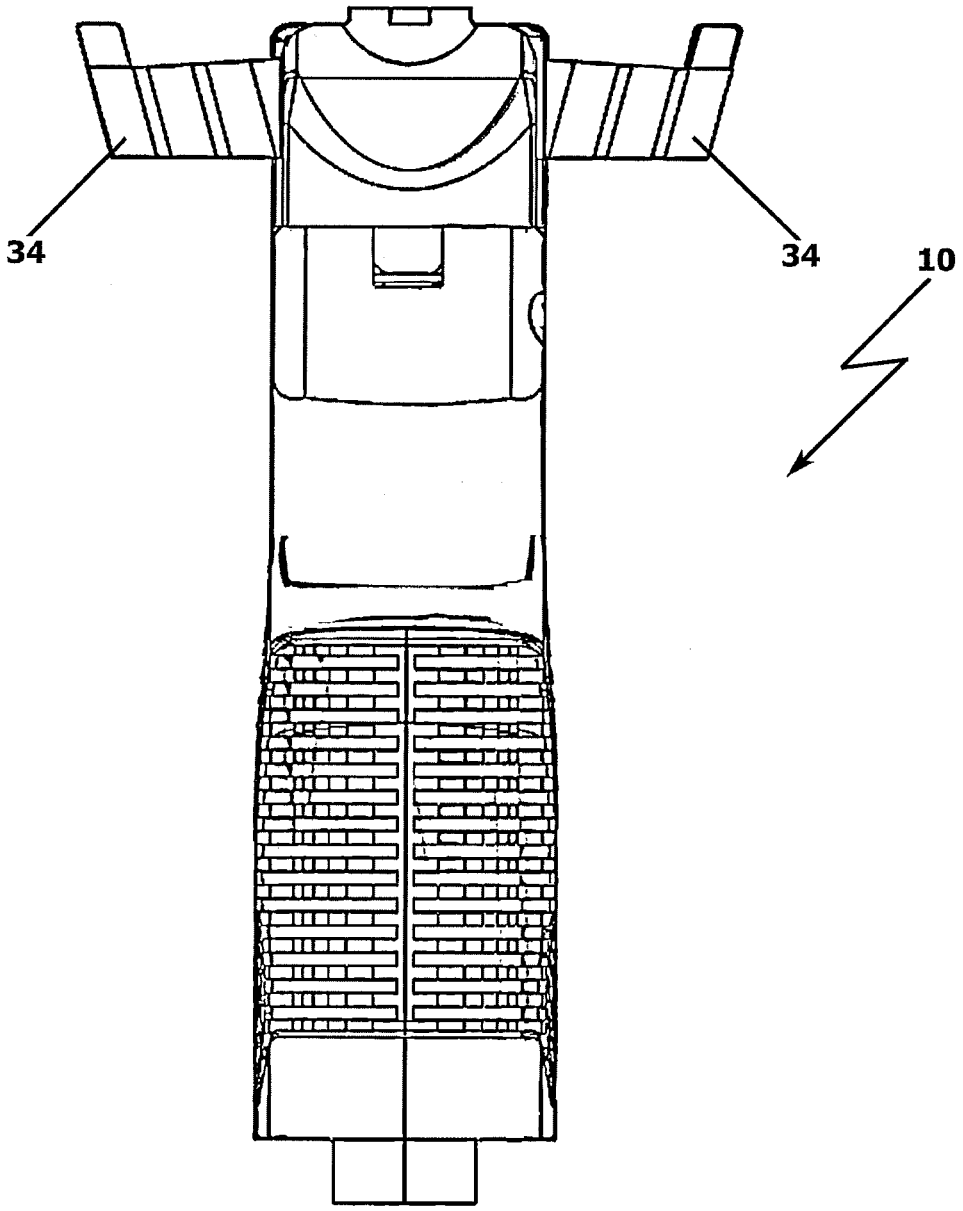
FIG. 7 depicts a back or rear perspective view of the pistol of FIG. 1 with slide members laterally extended.

FIG. 7 depicts a back perspective view of pistol 10 of the present invention with slide members 34 laterally extended.

Figure 8:
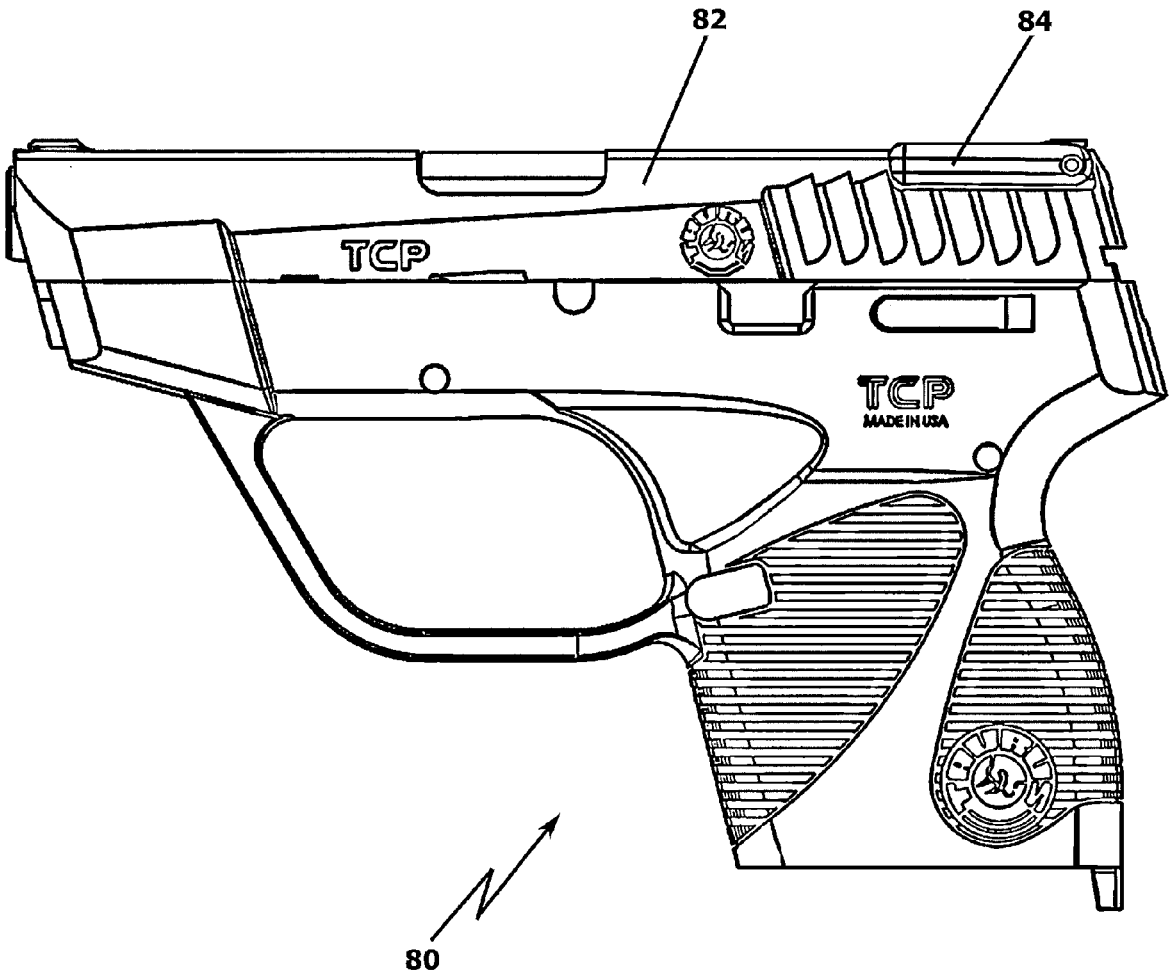
FIG. 8 depicts a pistol with a retracted, top mounted slide member at the back or rear end of the slide.
Figure 9:
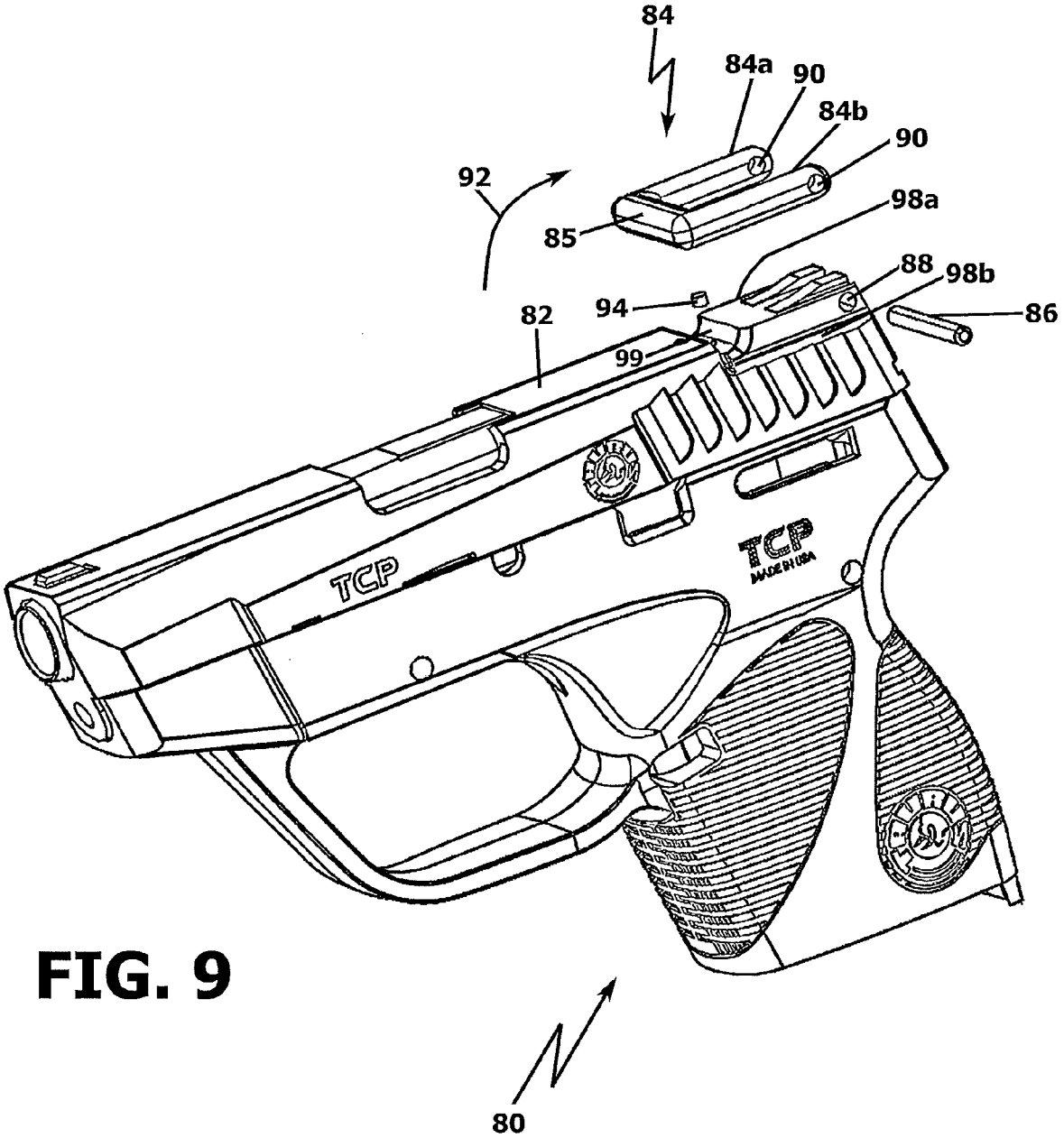
FIG. 9 is an exploded view of the pistol of FIG. 8 depicting an attachment scheme for the slide member.

In a separate embodiment, a slide member may be top mounted as depicted in FIG. 8. FIG. 8 depicts pistol 80 with retracted, top mounted slide member 84 shown at the back or rear end of slide 82. FIG. 9 is an exploded view of pistol 80 depicting an attachment scheme for slide member 84. Slide member 84 is attached at the back end of slide 82 by an axial rod 86 inserted within through-hole 88. Slide member 84 is U-shaped with leg members 84*a,b* and front member 85. Each leg member includes an aperture 90 located at the rearward end of slide member 84, which is adapted to receive axial rod 86. In this manner, slide member 82 is rotatable in the direction of arrow 92, extending upwards and rearwards relative to pistol 80. Front member 85 of slide member 84 is received by slide 82 in side grooves 98*a,b* and front groove 99. Side grooves 98*a,b* are designed to receive leg members 84*a,b* of slide member 84, respectively. Front member 85 may be magnetically secured to slide member 84 by magnetic contact 94.

Figure 10:
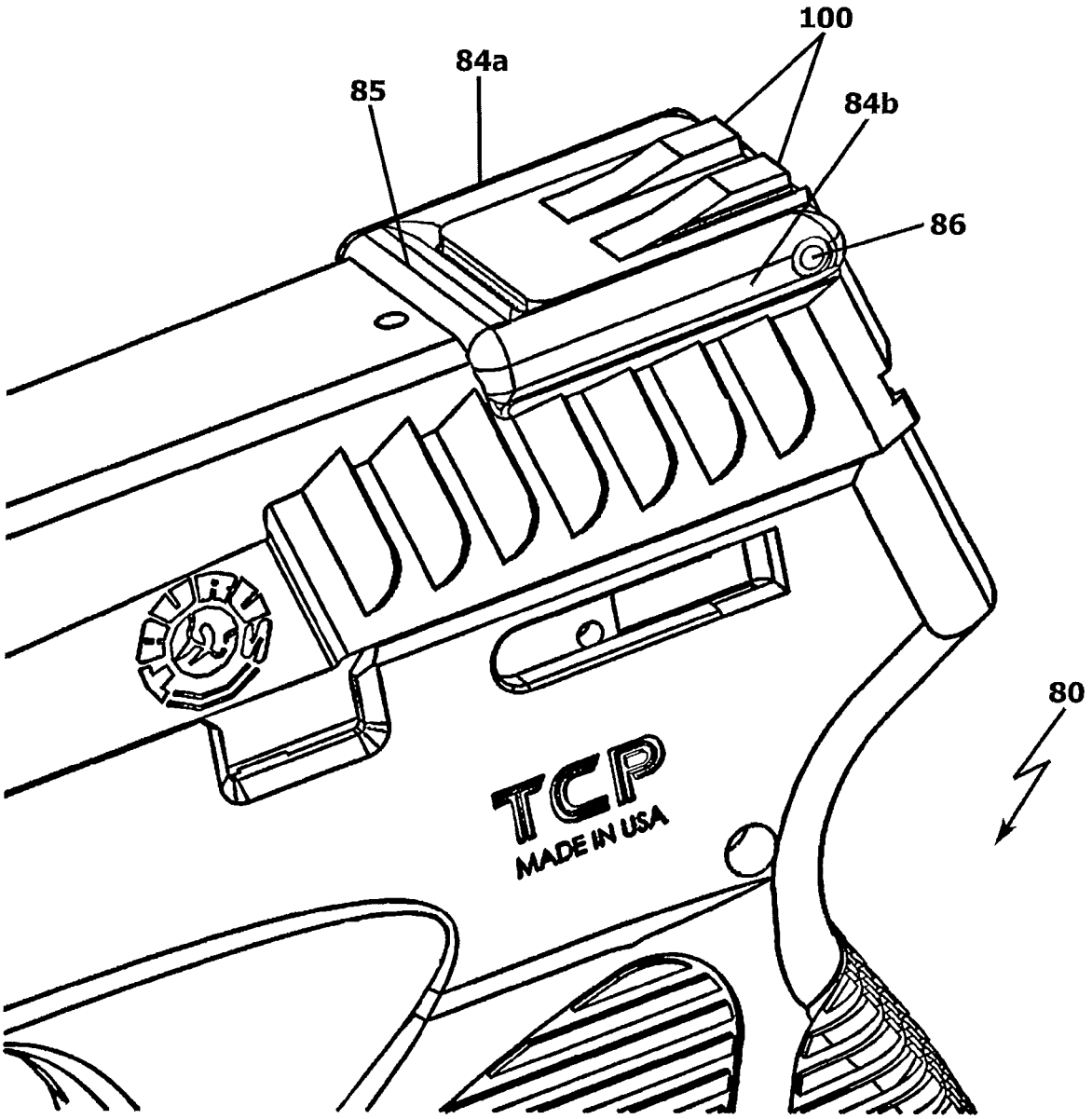
FIG. 10 is an exploded, partial, top perspective view of the pistol of FIG. 8, depicting the placement of the slide member in its retracted position.

FIG. 10 is an exploded, partial, top perspective view of pistol 80, depicting the placement of slide member 84 in its retracted position. The U-shaped slide member 84 is secured in grooves in the slide member, such that slide member 84 surrounds, but does not interfere with, rear sights 100.

Figure 11:
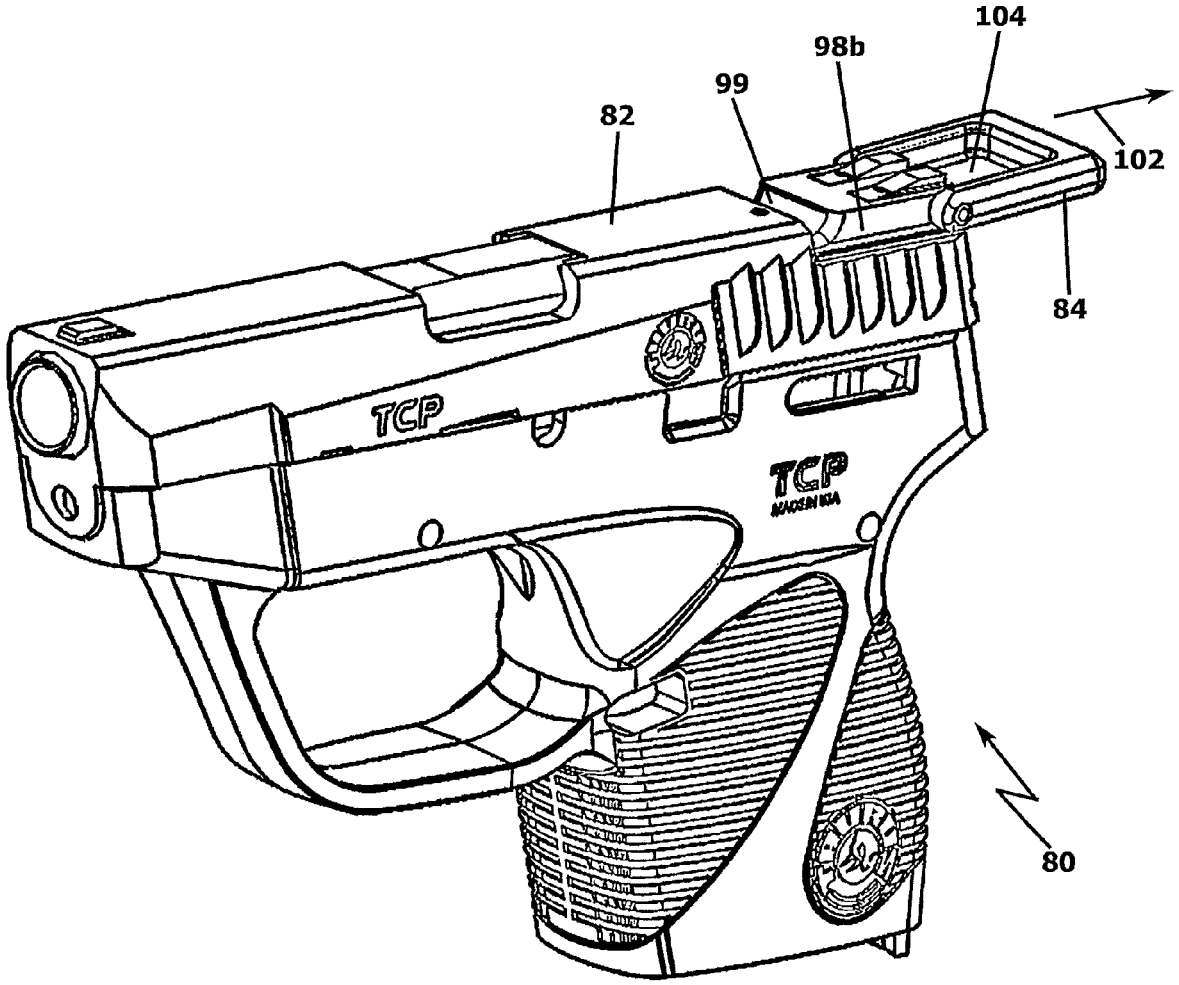
FIG. 11 depicts the pistol of FIG. 8 with the slide member in the extended, rearward position, with the slide still in its firing position.

FIG. 11 depicts pistol 80 with slide member 84 in the extended, rearward position, with slide 82 still in its firing position. A user may pull slide member 84 rearwards in the direction of arrow 102 using a single finger pull in gap 104.

Figure 12:
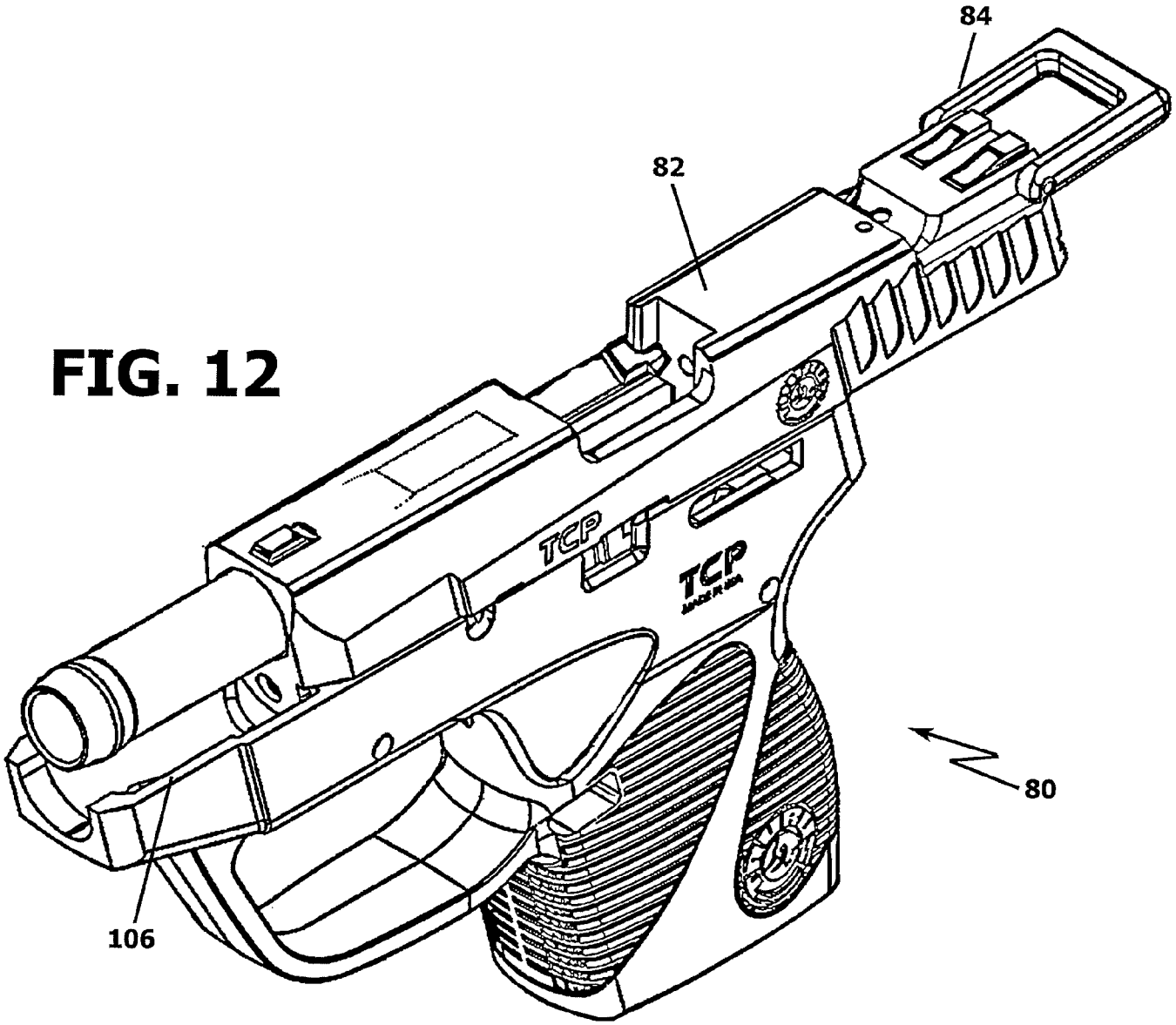
FIG. 12 depicts the pistol of FIG. 11 with the slide member extended, and the slide pulled or racked rearward on guides.

FIG. 12 depicts the pistol of FIG. 11 with slide member 84 extended, and slide 82 pulled rearward on guides 106.

The pistol slide and slide member of the present invention present a unique method for racking the slide. Essentially, a portion of the slide member initially placed in a retracted position is grasped, and the slide member is rotated laterally outwards from a side surface of the slide or vertically upwards from a top surface of the slide, such that said slide member is placed in an extended position. At this point, the slide member is grasped by the shooter, and pulled towards a breech end of the pistol. Upon release, the slide member is returned to its retracted position.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A pistol slide having a top surface facing upwards when said pistol is held in an upright position for firing, side surfaces adjacent said top surface and facing outwards left and right in a direction perpendicular to said top surface, a breech end, and a muzzle end opposite said breech end, said pistol slide including:

at least one extendable and retractable slide member located proximate said breech end of said slide, said slide member extending approximately laterally outwards from said side surface in said left or right direction perpendicular to said top surface when said slide member is in an extended position.

2. The pistol of claim 1 wherein said slide member is approximately flush-mounted with a side surface of said slide when said at least one slide member is in a retracted position.

3. The pistol slide of claim 1 including at least one slot for receiving each of said at least one slide members, said slot defined by a bottom surface, a breech end side wall, a muzzle end side wall, and a top segment, and formed such that said slide member is received within said slot.

4. The pistol slide of claim 3 wherein said top segment and said breech end side wall of said slot form a first groove, and said top segment and said muzzle end side wall of said slot form a second groove.

5. The pistol slide of claim 4 wherein said slide member includes a connection segment for rotatably attaching to said slide.

6. The pistol slide of claim 5 wherein said connection segment comprises an approximate cylindrical shape for rotatably attaching to said slide at said first groove of said slot.

7. The pistol slide of claim 6 wherein said first groove extends circumferentially more than 180° about said approximate cylindrical shape of said connection segment, securing said connection segment within said first groove while simultaneously allowing said connection segment to rotate relative to said slide.

8. The pistol slide of claim 5 wherein said slide member includes a lever arm adjacent to, and extending from, said connection segment such that said lever arm extends laterally outwards from said slide side surface when said slide member is in said extended position.

9. The pistol slide of claim 6 wherein said slide member includes a handle portion adjacent said lever arm, said handle portion having a lip portion extending approximately vertically upwards towards said slide top surface, said lip portion formed to fit within said second groove of said slot.

10. The pistol slide of claim 5 including:

an aperture within said slide slot proximate said first groove;

a bias member insertably supportable within said aperture; and a ball bearing biased by said bias member extending partially into said first groove, forming a biased detent for said connection segment.

11. A pistol comprising:

a frame for holding mechanical parts of said pistol, including a trigger housing and a bolt carrier group, said frame further includes a grip portion that receives a magazine;

a slide, longitudinally slidable with respect to said frame, said slide housing a firing pin or striker of said pistol and an extractor, said slide serves as a bolt for said pistol, said slide having a top surface facing upwards when said pistol is held in an upright position for firing, and side surfaces adjacent said top surface and facing outwards left and right in a direction perpendicular to said top surface, a breech end, and a muzzle end opposite said breech end; and at least one extendable and retractable slide member rotatably attached to said slide, said slide member located proximate said breech end of said slide, said slide member approximately flush-mounted with a side surface of said slide when said slide member is in a retracted position, and said slide member extending approximately laterally outwards from said side surface in said left or right direction perpendicular to said top surface when said slide member is in an extended position.

12. The pistol of claim 11 wherein said slide member includes:

a connection segment for rotatably attaching to said slide;

a lever arm for gripping by a shooter when said slide member is in said extended position; and a handle portion for grasping said slide member to extend said slide member laterally outwards from said slide.

13. The pistol of claim 11 including a slot within said slide for receiving said slide member, said slot defined by a bottom surface, a breech end side wall, a muzzle end side wall, and a top segment, and formed such that said slide member is received within said slot and approximately flush-mounted with said side surface when said slide member is in said retracted position.

14. The pistol of claim 13 wherein said top segment and said breech end side wall of said slot form a first groove, and said top segment and said muzzle end side wall of said slot form a second groove, for receiving said connection segment.

15. The pistol of claim 12 wherein said connection segment, said lever arm, and said handle are integrally constructed.

16. The pistol of claim 12 including:

an aperture within said slide proximate said first groove;

a bias member supported within said aperture; and a bearing biased by said bias member extending partially into said first groove, forming a biased detent for said connection segment.

17. The pistol of claim 16 wherein said bias member comprises a spring.

18. The pistol of claim 12 wherein said lever arm forms an arcuate shape concave inwards toward said side surface when said slide member is in said retracted position, said arcuate shape facilitating gripping by a user when said slide member is in said extended position.

19. The pistol of claim 13 including at least one magnetic contact for securing said slide member to said slide.

20. A method of racking a pistol having a pistol slide and a slide member rotatably attached to said pistol slide, comprising:

grasping a portion of said slide member in a retracted position and rotating said slide member at least partially laterally outwards from a side surface of said slide such that said slide member is in an extended position;

grasping said slide member in said extended position and pulling said slide member towards a breech end of said pistol thereby racking said pistol; and returning said slide member to said retracted position to ready said pistol for firing.

21. A pistol slide having a top surface, side surfaces adjacent said top surface, a breech end, and a muzzle end opposite said breech end, said pistol slide including:

at least one extendable and retractable slide member located proximate said breech end of said slide, said slide member extending approximately laterally outwards from said side surface when said slide member is in an extended position;

wherein said slide member is removably secured to said slide by magnetic contact.

* * * * *